US007607261B2

(12) United States Patent
Marocco

(10) Patent No.: US 7,607,261 B2
(45) Date of Patent: Oct. 27, 2009

(54) TOGGLE BAR AND SHUTTER

(76) Inventor: Mario M Marocco, 240 Bartor Rd., Toronto (CA) M9M 2W6

( * ) Notice: Subject to any disclaimer, the term of this patent is extended or adjusted under 35 U.S.C. 154(b) by 62 days.

(21) Appl. No.: 11/984,143

(22) Filed: Nov. 14, 2007

(65) Prior Publication Data

US 2009/0119999 A1 May 14, 2009

(51) Int. Cl.
*E06B 7/086* (2006.01)

(52) U.S. Cl. ..... 49/87.1

(58) Field of Classification Search ..... 49/74.1, 49/87.1

See application file for complete search history.

(56) References Cited

U.S. PATENT DOCUMENTS 5,187,896 A * 2/1993 Ross ..... 49/74.1
5,303,507 A * 4/1994 Oille ..... 49/74.1
5,548,925 A * 8/1996 Marocco ..... 49/74.1
5,778,598 A * 7/1998 Ohanesian ..... 49/74.1
6,041,547 A * 3/2000 Marocco ..... 49/87.1
6,250,012 B1 * 6/2001 Ricci ..... 49/87.1
6,418,665 B1 * 7/2002 Gabriele ..... 49/87.1
7,377,074 B2 * 5/2008 Marocco ..... 49/87.1
2004/0025438 A1 * 2/2004 Marocco ..... 49/87.1

* cited by examiner

*Primary Examiner*—Jerry Redman

(57) ABSTRACT

A shutter having a frame, hollow louvres rotatably supported in the frame, and a control bar for controlling the louvres and one-piece connector members connecting the louvres to the control bar in which the connector member has a T-member with integral rigid arms extending normal to the stem on either side for insertion into a louvre, a stem integral with the T-member and an abutment on the stem which prevents movement of the stem into the interior of the louvre and ribs within the louvre for locating the arms and assisting in providing a hinge action and attachments for attaching to a control bar.

8 Claims, 3 Drawing Sheets

TOGGLE BAR AND SHUTTER

FIELD OF THE INVENTION

The invention relates to shutters of the type having a frame and louvres rotatable in the frame and a control bar connected to the louvres for rotating them open and closed and a one-piece connector for connecting the control bar to the louvres.

BACKGROUND OF THE INVENTION

Shutters for windows and doors usually have a frame hinged to the window or door opening and rotatable louvres extending across the frame from side to side. A control bar is connected to the louvres. Moving the control bar rotates all the louvres. In this way, the louvres can be titled open for light and air or tilted up or down and closed for privacy.

Shutters have been made in this general pattern for hundreds of years. Usually they were made of wood. It is now practice to make at least the louvres from hollow extruded plastic. The control bar also is usually made of plastic. It is desirable to provide a simple connector for connecting the control bar to each of the louvres. This connector should provide a secure attachment to both the control bar and also to each of the louvres. The connector must also permit tilting of the louvres up or down as the control bar is moved.

Various different connector devices have been used in the past. One such system is shown in U.S. Pat. No. 5,778,598 H. Ohanesian, Jul. 14, 1998. This system uses connectors with a T-shaped member. The T-member fits into an opening in the hollow plastic louvre. It then retains the connector member connected to the louvre. It is also intended to permit rotation of the louvre as it tilts. One of the problems with this system is that the T-member tends to slip into the interior of the louvre. When this happens the louvre can no longer tilt freely. Movement of the control bar may result in damage to the louvre or the connector member or both.

It also produces an unsightly appearance. Another factor is that the connector member must also be installed in the control bar. In the earlier system, this installation was complex and required some manipulation to install it.

Another system is shown in U.S. Pat. No. 6,418,665 A. Gabriele, Jul. 16, 2002. In this system, the connectors were attached to a stick. The stick was then installed in the control bar. This imposed limits on the spacing between louvres. The spacing of the louvres depends on the actual size of the window opening. This may vary. In order to adjust for this, the shutters may have to be made with custom specific louvre spacings. An improved system is shown in U.S. Pat. No. 5,548,925 N. Marocco, Aug. 27, 1996. In this system, the connectors are separate from the control bar. However, there is nothing to prevent the connectors from slipping into the interior of the louvres. It is desirable to provide a connector member which is simple to attach to each louvre and which does not slide into the interior of the louvre and which can be installed on the control bar simply and effectively with a minimum of hand labour and training. Also, the design of the control bar should complement the features of the connector member so that the two work together to achieve the desired result.

BRIEF SUMMARY OF THE INVENTION

With a view to providing shutters with a connector member which satisfied these objectives, the invention provides a shutter having a frame and hollow louvres and a control bar for controlling the louvres and one-piece connector members connecting the louvres to the control bar in which the one-piece connector member is formed with a T-member for insertion into the louvre and a stem for insertion into the interior of the louvre. Preferably, the connector member has a stem which has an abutment forming a shoulder and a reduced neck between the abutment and the T-member. Preferably, the connector member is formed with a shoulder which is of rectangular shape in section.

Preferably, the connector T-member has two arms of equal length, the arms being of cylindrical shape and cross section with tapering ends.

Preferably, the connector member has an attachment portion for installation on the control bar which attachment portion is formed by an endwise extension of said stem away from said T-member.

Preferably, the connector member attachment portion has a central axial pin of cylindrical shape and two wings extending perpendicularly along opposite axes on either side of said pin.

Preferably, the connector member has a rectangular-shaped block formed integrally with said pin and said wings.

Usefully, the louvres will be formed with a hollow section formed of blade walls of a generally aerofoil shape and defining a hollow interior with openings formed in said louvres for receiving said connector members and with interior ribs on either side of said opening for gripping said T-member thereby providing a smooth hinging action and also assisting in preventing it from sliding into the interior of said louvre.

Usefully, the control bar will be formed of plastic as a hollow extrusion with a channel defining an opening mouth and with retention flanges on either side of said opening mouth for receiving and engaging said wings of said connector member.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
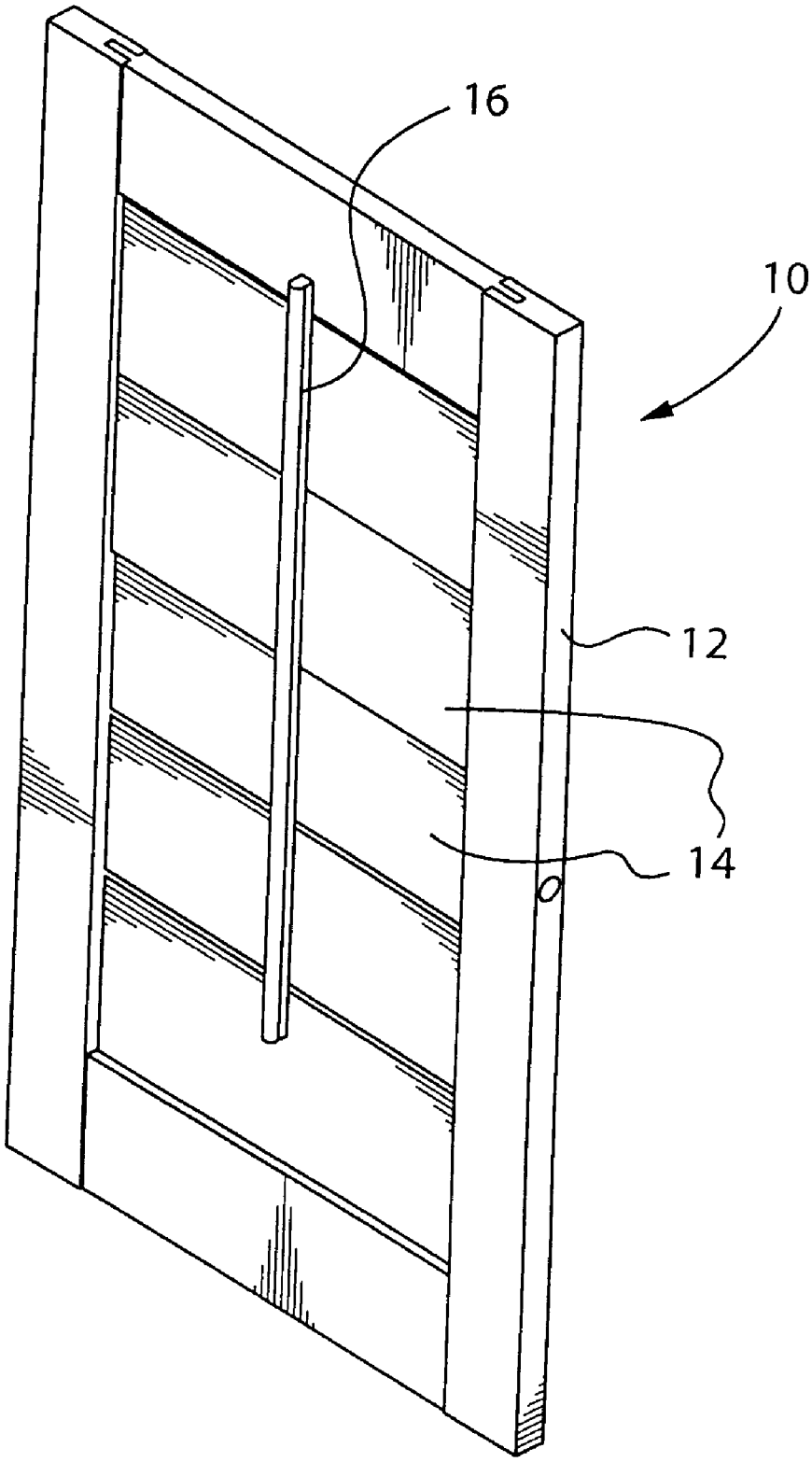
FIG. 1 is a perspective illustration of a shutter with louvres and with a control bar and connector member illustrating the invention.

As already described in general, a shutter (10) consists of a rectangular frame (12) with sides and a top and bottom. Louvres (14) are rotatably located between the two sides of a frame and a control bar (16) (FIG. 1) is connected to the louvres. Typically, the shutter will be hung by hinges (not shown) in a window or a door opening. As such, the general construction and the location and use of shutters of this general type is well known.

Figure 2:
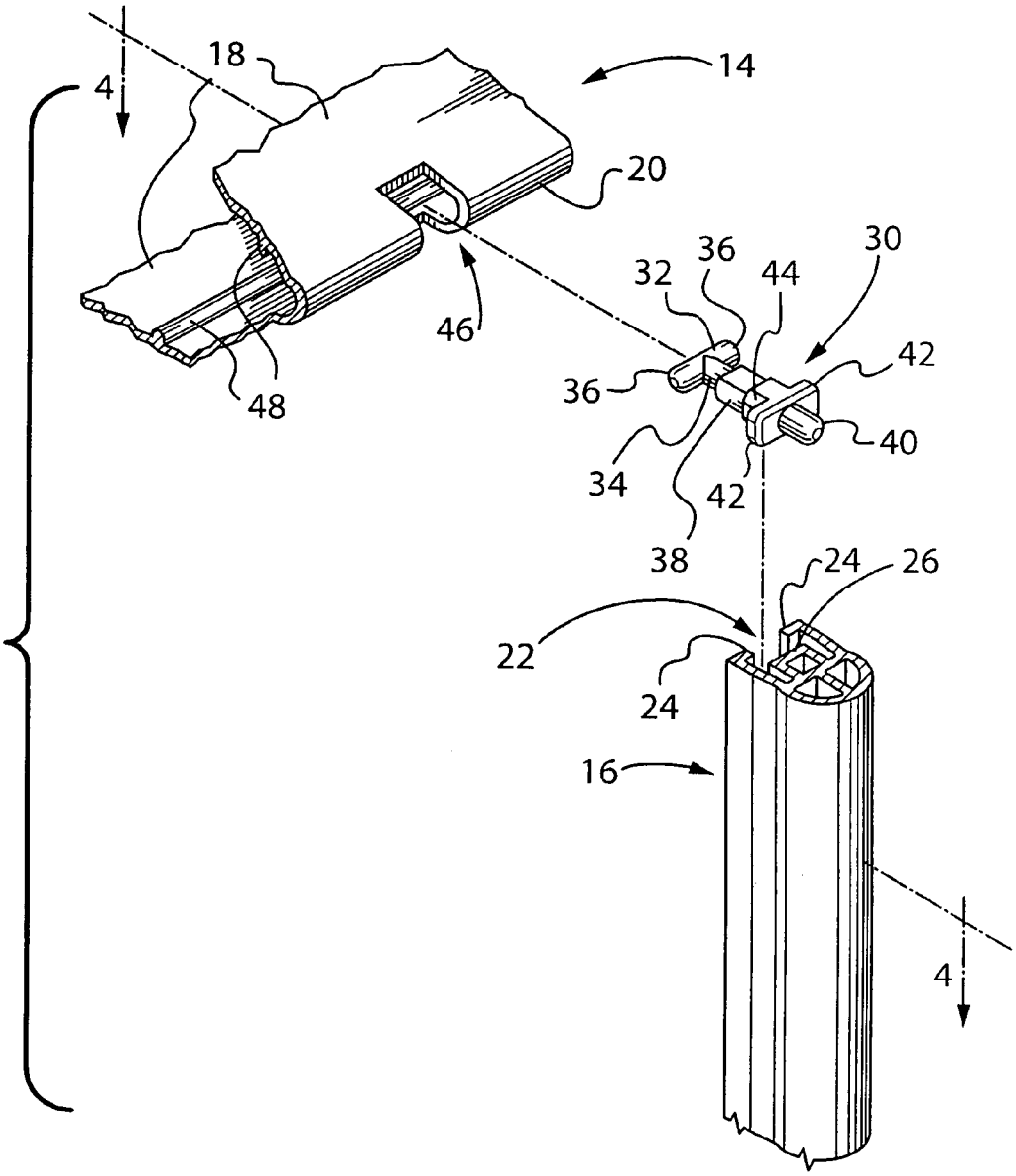
FIG. 2 is a perspective illustration of the control bar and a louvre shown in isolation with a louvre partially cut away.
Figure 3:
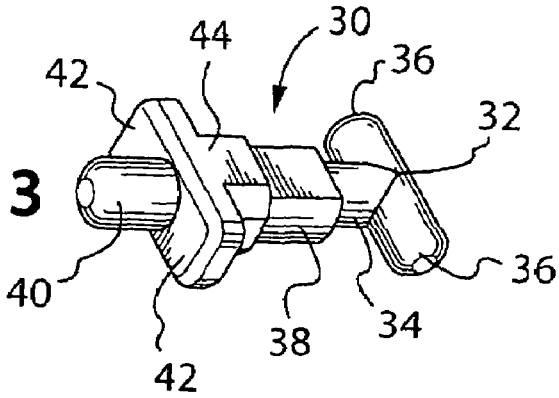
FIG. 3 is a perspective illustration of a connector member shown in isolation.
Figure 4:
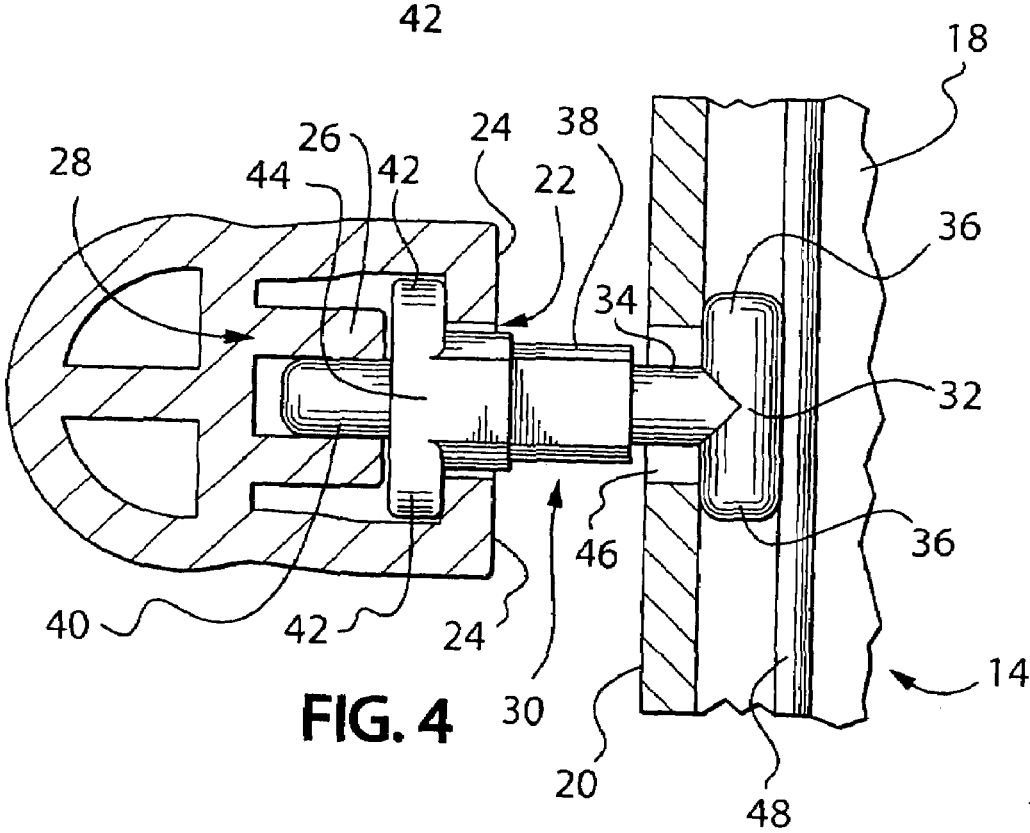
FIG. 4 is a section illustration showing the connector member and a portion of a control bar and a louvre.
Figure 5:
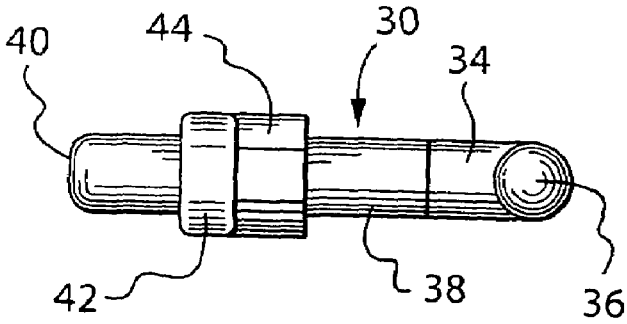
FIG. 5 is a side elevation illustration of a connector member.
Figure 6:
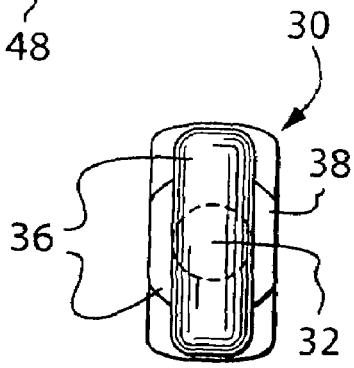
FIG. 6 is an end illustration of a connector member.

In accordance with the present invention, the louvres (14) are hollow and are formed of extruded plastic construction and define a hollow interior (FIG. 2). The louvres (14) define a generally aerofoil shape in section with upper and lower blade walls (18) of generally convex shape meeting along edges (20).

At each end, each louvre (14) is provided with a pivot (not shown) which fits in a receiving recess (not shown) in the side members of the frame (12).

The louvres (14) can be rotated between open and closed position to either admit light or exclude it. This also provides privacy.

To open and close the louvres altogether and maintain them all in uniform position, a control bar (16) is provided.

Control bar (16) in this embodiment is formed of extruded plastic hollow construction. Control bar (16) defines a channel (22) having an open mouth and having retention flanges (24) along either edge of the channel (22). An intermediate wall (26) extends between the sides of channel (22).

Openings (28) are formed in wall (2*b*) of control bar (16) at spaced intervals for reasons to be described.

In order to connect the several louvres (14) to the control bar (16), one piece integral connector members (30) are provided (FIGS. 3 to 6).

Each connector member (30) is of integral one-piece construction.

Connector member (30) has a T-member (32) at one end. A stem (34) extends from the T-member (32) perpendicular to it. The T-member (32) comprises two rigid integral arms (36) formed in one piece with said T-member and aligned with one another extending in opposite directions on either side of stem (34) and defining tapering ends. Stem (34) is of cylindrical cross section. A rectangular abutment shoulder (38) is formed on stem (34) spaced from T-member (32). Shoulder (38) is thicker than stem (34) and assists in preventing the stem (34) and T-member (32) from sliding too far into the interior of the louvre.

On the other end of connector member (30) there is a pin (40) of cylindrical shape in section. A pair of wings (42) extend out perpendicular on either side of pin (40). A rectangular-shaped block (44) is formed integrally with wings (42).

Connector members (30) are coupled to respective louvres (14) by inserting the T-member into an opening (46) in a louvre (14) and then rotating the T-member (32) 90 degrees. The louvres have interior ribs (48) extending along the interior surfaces of the upper and lower blade walls (18).

The T-member (32) is then pulled slightly back ensuring that the arms (36) do not slip into the interior past the ribs (48). The arms (36) of the T-member will then lie in the interior of the edge (20) where the blade walls (18) of louvres (14) meet one another and are held there by the ribs (48). Connector members (30) are attached to control bar (16) by inserting the pin (40) into a respective opening (26) in control bar (16) with the two wings (42) lying between the two retention flanges (24). Control bar (16) may then rotate so that the two wings (42) twist 90 degrees and engage the retention flanges (24) of the control bar (16). In this way, the louvres (14) and the control bar (16) can be coupled together into an assembly which can then be placed in the two sides of frame (12).

In order to retain the T-member (32) in the edge of (20) of a louvre (14), the blade walls (18) are formed on their interior surfaces with retention ribs (48). Ribs (48) run from end to end of interior of the louvre adjacent to the edge but spaced back from the edge a distance sufficient to permit the T-member to co-operate and provide a hinging action when the control bar is operated.

These ribs (48) engage the arms (36) of the T-member (32) and hold them against the inside surface of the edge (20) of the blades (18) and also assist in preventing the T-member (32) from slipping further into the interior of the louvre (14).

Once installed, the louvres (14) can be moved in unison by moving the control bar (16) as desired. The arms (36) rotate in the interior of the louvres being held between the inside of edges (20) and ribs (48) and thus provide the desired smooth hinging action. The arms (36) and the T-member (32) cannot slip further into the interior of the louvres (14) due to the ribs (48) and the shoulder (38) on stem (34).

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shutter having a frame and having hollow louvres rotatably supported in the frame, openings in said louvres and a control bar for controlling the louvres and having a plurality of separate one piece connector members connecting respective louvres to the control bar and comprising:

a hollow extrusion forming said control bar having a channel defining an open mouth and a wall extending across said channel;

pin openings at spaced intervals in said wall;

retention flanges on either side of said open mouth;

and wherein each said separate one piece integral connector comprises a T-member for insertion into a louvre;

rigid arms formed integrally with said T-member and extending perpendicular on opposite sides of said T-member, said arms being received within said louvre;

a stem integral with the T-member;

an integral abutment portion on said stem which restricts movement of said stem into the interior of the louvre; a pin on the end of said stem for insertion into a respective said pin opening in said wall of said control bar;

and, rigid attachment wings formed integrally with said stem member extending normal to said pin and positioned to be inter-engaged with said retention flanges of said control bar.

2. A shutter as claimed in claim 1 wherein said abutment portion forms a shoulder and including a reduced neck defined by said stem between the shoulder and the T-member.

3. A shutter as claimed in claim 2 wherein said shoulder is of rectangular shape in section.

4. A shutter as claimed in claim 3 wherein said integral arms on said T-member are of equal length, the arms being of cylindrical cross section and tapered at their free ends.

5. A shutter as claimed in claim 4 including a central axial pin of cylindrical shape and two rigid integral wings extending perpendicularly therefrom, extending along opposite axes on either side of said pin.

6. A shutter as claimed in claim 5 including a rectangular-shaped block formed integrally with said pins and said wings.

7. A shutter as claimed in claim 1 wherein said louvres are formed in section in a generally aerofoil shape and comprise two blade walls and enclosing a hollow interior with openings formed in said louvres for receiving said T-members and including interior ribs on said blade walls on either side of said opening, adjacent to but spaced from said edge for engaging said rigid arms of said T-member thereby preventing them from sliding into the interior of said louvre.

8. A shutter as claimed in claim 7 wherein said control bar is formed of synthetic plastic material as a hollow extrusion.

* * * * *